United States Patent [19]

Lally

[11] Patent Number: 4,554,910

[45] Date of Patent: Nov. 26, 1985

[54] CARDIO PULMONARY RESUSCITATION PRESSURE INDICATOR

[75] Inventor: James J. Lally, Shawnee Mission, Kans.

[73] Assignee: Health Education Publication Company, Inc., Kansas City, Mo.

[21] Appl. No.: 470,609

[22] Filed: Feb. 28, 1983

[51] Int. Cl.[4] ..... A61H 31/00

[52] U.S. Cl. ..... 128/28; 128/54; 446/415; 446/418

[58] Field of Search ..... 128/28, 30.2, 51, 54, 128/30, 24 R; 446/397, 415, 418

[56] References Cited

U.S. PATENT DOCUMENTS

| | | | |
|---|---|---|---|
| 4,019,501 | 4/1977 | Harris | 128/24 R |
| 4,059,099 | 11/1977 | Davis | 128/51 |
| 4,077,400 | 3/1978 | Harrigan | 128/24 R |
| 4,237,872 | 12/1980 | Harrigan | 128/24 R |

*Primary Examiner*—Richard J. Apley
*Assistant Examiner*—H. Macey
*Attorney, Agent, or Firm*—Schmidt, Johnson, Hovey & Williams

[57] ABSTRACT

A portable, easy to use cardio pulmonary resuscitation (CPR) pressure indicator is described which can be placed on a patient's chest to transmit successive resuscitation compression forces applied by a treating person and give a perceptible (e.g., audible) signal when an appropriate force and resultant compression stroke has been achieved. In preferred forms, the indicator device includes force transmitting structure presenting a first surface for placement on a patient's chest region, a second surface for engagement by the hands of a person treating the patient, and structure for transmitting force supplied by the person through the first surface and to the chest region of the patient. The overall device further includes a signal generator operably coupled with the force-transmitting structure for giving a perceptible signal when a predetermined force has been transmitted to the patient's chest region. Advantageously, the overall device includes separate, opposed, upper and lower plates operably coupled for movement of the upper plate relative to the lower plate when force is applied to the former, including biasing structure such as a coiled spring interposed between the upper and lower plates for resisting relative plate movement. The signal is advantageously generated by provision of a spring metal body interposed between the plates and configured for deflecting and giving an audible "click".

7 Claims, 8 Drawing Figures

Fig. 1
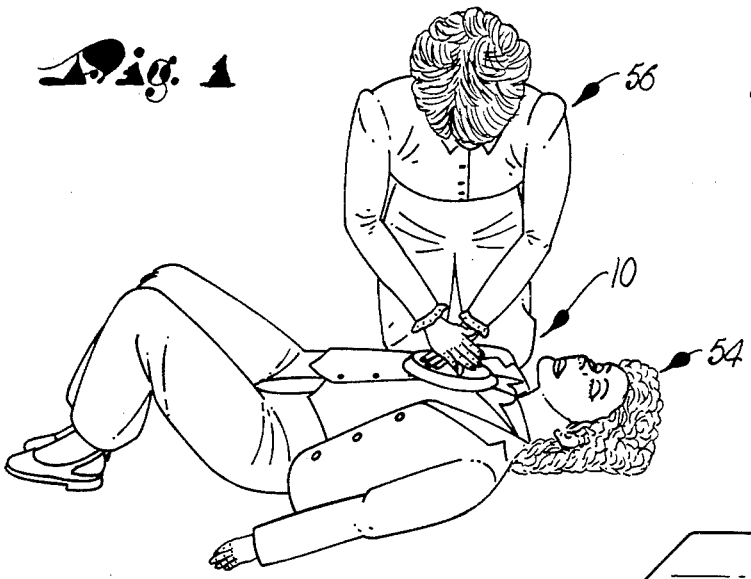
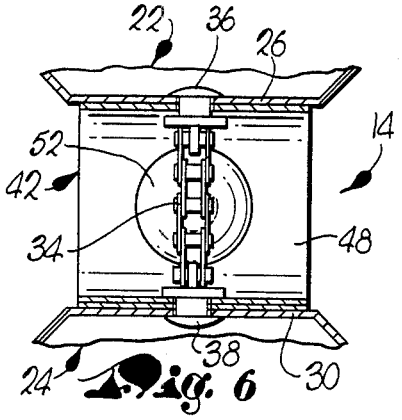
Fig. 6
Fig. 2
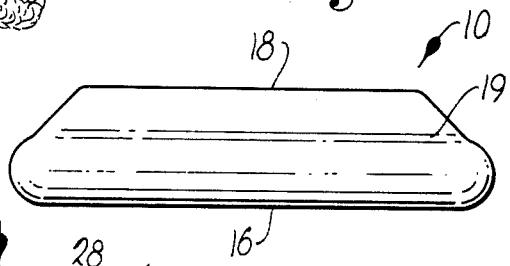
Fig. 3
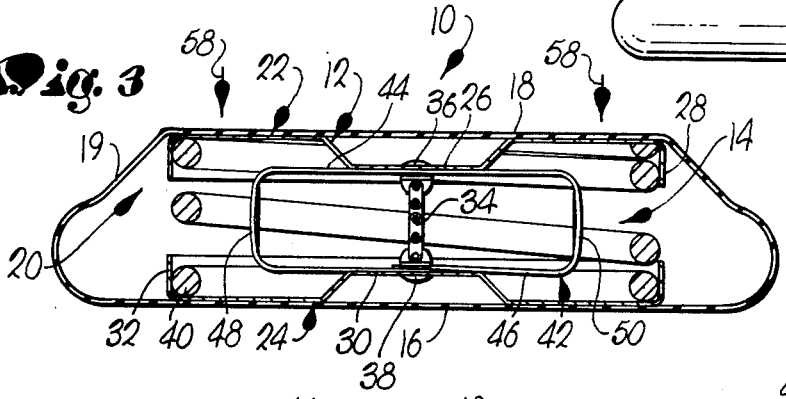
Fig. 5
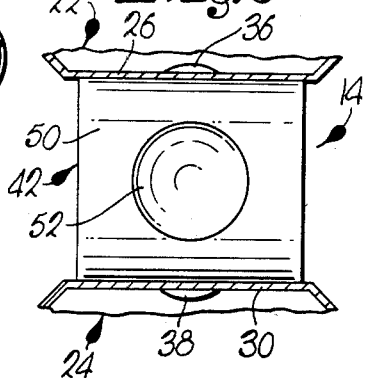
Fig. 4
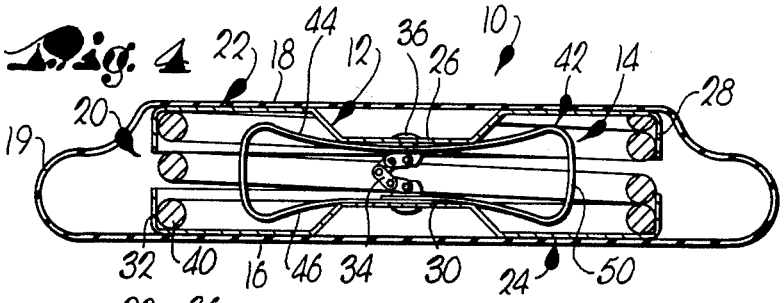
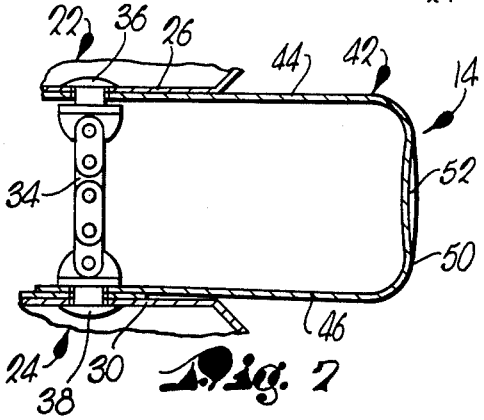
Fig. 7
Fig. 8
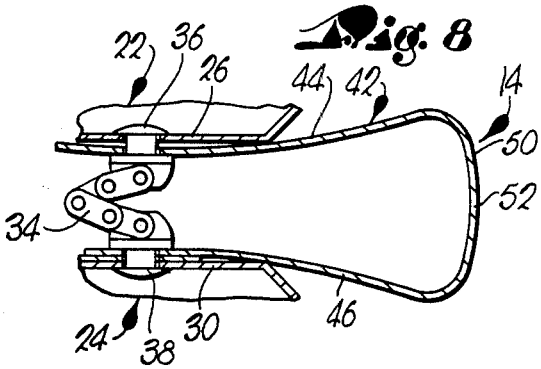

CARDIO PULMONARY RESUSCITATION PRESSURE INDICATOR

BACKGROUND OF THE INVENTION

1. Field of the Invention

The present invention is broadly concerned with a device to facilitate proper application of cardio pulmonary resuscitation (CPR). More particularly, it is concerned with such a device which can be placed on a patient's chest to give a perceptible indication when appropriate compression forces are applied, in order to eliminate the possibility that insufficient compression strokes are given during the procedure.

2. Description of the Prior Art

Every year heart attack accounts for over 350,000 deaths which occur before the victim reaches the hospital. The most dangerous period in a heart attack is during the first two hours after the onset of symptoms. At any moment during a heart attack, the victim's heart could stop beating. If such occurs, it is absolutely necessary that CPR be commenced immediately in order to save the victim from death.

In recent years emergency CPR techniques have become quite refined, and indeed many public agencies offer courses and other instructional material so as to teach the proper technique to a large segment of the populace. Broadly speaking, proper CPR involves first placing a victim flat on his back on a hard surface, and initially taking the necessary steps to ensure that the victim is breathing usually be means of mouth to mouth resuscitation if necessary. After these initial steps, successive chest compressions are begun. This involves finding the notch at the tip of the patient's breast bone, and measuring up two fingers of one hand, whereupon the heel of the other hand is placed on the lower one-third of the breast bone alongside the two fingers of the first hand. The first hand is then placed upon the second, and the elbows locked. Chest compression is thereupon achieved by pressing straight down to compress the chest one and one-half to two inches, with each complete compression (down and up) to last three-fourths of a second. This compression procedure is repeated, with a period of about three-fourths of a second between each compression, for a total of fifteen compressions. At this point mouth to mouth resuscitation is resumed for two breaths, and the compression procedure is repeated.

While the CPR technique described above is quite effective, a number of problems remain. For example, it is sometimes difficult to determine whether sufficient compressive forces have been applied to the patient's chest region, particularly for an inexperienced treating person. Moreover, it is important that the treating person not press down on the chest wall with the fingers, inasmuch as this could cause fractured ribs in the patient. In short, while CPR is an effective life saving technique, in the hands of the inexperienced it can be useless or even dangerous to the patient.

SUMMARY OF THE INVENTION

The present invention overcomes a number of the problems outlined above, and provides a CPR indicator device which greatly facilitates the proper application of CPR techniques. Broadly speaking, the device of the invention includes force transmitting structure adapted for placement on a patient's chest region and engageable by the hands of the treating person in order to transmit compressive forces from the user to the patient's chest. The overall device further includes signal means operably coupled with the force-transmitting structure for giving a perceptible signal when a predetermined force has been transmitted to the patient's chest region.

Preferably, the device includes a pair of relatively large, circular plates oriented in an opposed, spaced apart relationship, and coupled such that the upper plate is shiftable relative to the lower plate. Biasing means such as a circular coil spring is interposed between the plate means for resisting movement of the upper plate means. The signal generating means preferably includes structure for generating an audible signal, and advantageously is in the form of a deflectable spring steel body positioned for deflection thereof when force is applied to the device in order to generate an audible "click" which tells the treating person that an appropriate compression stroke has been completed.

BRIEF DESCRIPTION OF THE DRAWING

FIG. 1 is a view illustrating use of the indicator device of the present invention on a heart attack victim;

FIG. 2 is a side elevational view of the indicator device;

FIG. 3 is a vertical sectional view of the device depicted in FIG. 2;

FIG. 4 is a view similar to that of FIG. 3, but illustrates the device in a compressed condition;

FIG. 5 is a fragmentary vertical section view illustrating the end of the signal generating spring steel body forming a part of the indicator device, with the preformed "dimple" in the end of the device being illustrated;

FIG. 6 is a view similar to that of FIG. 5, but illustrates the internal face of the dimpled end wall of the spring steel body, along with the flexible roller chain connector extending between the upper and lower plates;

FIG. 7 is an enlarged, fragmentary vertical sectional view illustrating the configuration of the spring steel indicator body in a relaxed position; and FIG. 8 is a view similar to that of FIG. 7, which illustrates the configuration of the body when compressed and after an audible "click" has been generated by outward suction of the dimpled end wall thereof.

DESCRIPTION OF THE PREFERRED EMBODIMENT

Turning now to the drawing, a cardio pulmonary resuscitation pressure indicator device 10 is illustrated in FIGS. 2–4. The device 10 broadly includes force transmitting structure broadly referred to by the numeral 12, as well as signal means 14 operatively coupled with the structure 12 giving a perceptible signal when a predetermined force has been transmitted.

In more detail, the force transmitting structure 12 includes a first lower surface 16 for placement on a patient's chest region, a second upper surface 18 for engagement by the hands of a person treating the patient, an outermost resilient synthetic resin casing 19 surrounding the surfaces 16, 18, and means 20 between the surfaces 16, 18 for transmitting forces applied by the treating person through the first surface into the chest region of the patient.

The force transmitting means 20 includes an upper plate 22 and a lower plate 24 oriented in an opposed, spaced apart relationship. The upper plate 22 is circular in plan configuration, and includes a central, circular, recess connection wall 26 as well as an outermost, depending circumferential lip 28. Similarly, the wall 24 includes a recessed, central connection wall 30, and an upstanding, circumscribing lip 32. It will be observed in this respect (see FIG. 3) that the plates 22, 24 are in alignment, with the respective lips 28, 32 extending toward each other.

The plates 22, 24, are interconnected by means of a flexible coupling link in the form of a stretch of roller chain 34. As best seen in FIG. 6, a pair of connection rivets 36, 38 are respectively inserted through appropriate apertures in the walls 26, 30, and are connected to the opposed ends of roller chain 34. As will be readily appreciated, the chain 34 serves to limit the maximum spacing between the plates 22, 24, and to couple the same together; nevertheless, the chain 34 permits relative movement of plate 22 relative to plate 24 for purposes to be described.

The force transmitting means 20 further include a large coil spring 40 which is situated between and engages the respective plates 22, 24. As seen in FIGS. 3 and 4, the outer surfaces of the spring 40 engage the lips 28, 32 of the plates 22, 24, whereas the upper and lower ends of the spring bear against the internal surfaces of the plates. Those skilled in the art will readily appreciate that the spring 40 serves to urge and bias the plates 22, 24 apart, such biasing movement being limited however by means of the chain 34.

Signal means 14 is advantageously in the form of a generally rectangular, tubular spring steel body 42 presenting opposed, apertured, spaced apart upper and lower walls 44, 46, and opposed sidewalls 48, 50 interconnecting the upper and lower wall 44, 46. Each sidewall 48, 50, is provided with a circular, normally inwardly extending depression or "dimple" 52 which is important for purposes to be described.

The body 42 is interposed between the upper and lower plates 22, 24 and is in direct engagement with the respective central connection walls 26, 30. To this end, the connection rivets 36, 38 extend through the apertures in the body walls 46, 48 (see FIG. 6), and chain 34 is therefore situated between the last mentioned body walls. Thus, the body 42 is interposed between and operably connected to the plates 22, 24.

The use of device 10 is illustrated in FIG. 1, which depicts a heart attack victim 54 lying in a supine position while a treating person kneels above the victim's chest region. The device 10 is placed on the victim's chest region as illustrated, with the surface 16 in direct engagement with the chest region. The person 56 then places his or her hands directly upon the upper surface 18 and presses downwardly in the direction illustrated by arrows 58 of FIG. 3. This downwardly directed force is continued until an audible "click" is heard, which is a signal that sufficient force has been applied to achieve a proper chest compression; and at this point the device 10 is released in preparation for another resuscitation stroke.

During the above described operation, the downwardly directed force applied by the treating person's hands first causes the coil spring 40 to compress as viewed in FIG. 4, with the result that plate 22 is shifted toward plate 24. This shifting action is permitted by virtue of the flexible coupling chain 34 which collapses during downward travel of plate 22 toward plate 24. In order to achieve the audible "click" which is indicative of a proper compression stroke, the body 42 is compressed along with spring 40. This action is illustrated in FIGS. 4 and 8, wherein it will be seen that the body 42 is compressed at the central region thereof, particularly the central areas of the upper and lower walls 44, 46. This compression in turn causes the dimpled portions 52 of the end walls 48, 50 to deflect outwardly so that the dimpled regions, which are normally concave as viewed in FIG. 7, assume a convex configuration as depicted in FIG. 8. This deflection of the dimpled regions 52 generates a sharp, audible "click" which is immediately perceptible and recognizable by the treating person 56.

When the downwardly directed force on device 10 is relieved, the coiled spring 40 serves to quickly urge the plate 22 back to its normal position illustrated in FIG. 3, while chain 34 serves to limit the extent of relative plate movement during this sequence. Moreover, during this return movement sequence, the body 42 reassumes its original configuration as illustrated in FIG. 3. During this movement, the dimpled portions 52 also return to their normal concave configuration, and a return movement "click" is heard by the user, thus indicating that the device 10 is ready for use in another compression stroke.

The device 10 can be readily modified for use on different types of patients. For example, the spring 40 can be of various strengths depending upon the intended use and the other parameters of device 10. Moreover, while the audible signal generating body 42 is preferred, it will be recognized that other sorts of signal generating devices could conceivably be employed.

Those skilled in the art will also appreciate that the large, circular nature of the device 10 virtually eliminates the possibility that the user could inadvertently apply a damaging point force to a victim's chest region. Finally, provision of a calibrated force-transmitting structure assures that sufficient force will be applied during the CPR technique to achieve the intended purpose.

I claim:

1. A cardio pulmonary resuscitation pressure indicator comprising:

force-transmitting structure including a first surface for placement on a patient's chest region, a second surface for engagement by the hands of a person treating said patient, and means for transmitting force applied by said person through said first surface to the chest region of said patient, said force-transmitting means being positioned between said first and second surface and comprising upper and lower plate means oriented in an opposed, spaced apart relationship and means operably coupling said upper and lower plate means for movement of the upper plate means relative to the lower plate means when said force is applied, including biasing means interposed between said upper and lower plate means for resisting said movement of said upper plate means, said biasing means comprising a coil spring in engagement with the adjacent faces of said upper and lower plate means, said coupling means including flexible connector means for interconnecting said upper and lower plate means and for limiting the maximum spacing between the plates; and signal means operably coupled with said force-transmitting structure for giving a perceptible signal when a predetermined force has been transmitted to said patient's chest region.

2. The indicator of claim 1, said signal means including structure for generating an audible signal.

3. The indicator of claim 2, said audible signal generating structure comprising a deflectable spring steel body positioned for deflection thereof when said force is applied.

4. The indicator of claim 1, said signal means comprising a spring steel body interposed between said upper and lower plate means and operably engaging said upper plate means, said body being deflectable upon said movement of said upper plate means and being configured to generate an audible signal in response to such deflection.

5. The indicator of claim 1, said structure including resilient cover means covering said first and second surfaces.

6. A cardio pulmonary resuscitation pressure indicator comprising:

force-transmitting structure including a lower plate having a surface for placement on a patient's chest region, an upper plate in opposed, spaced apart, generally parallel relationship to said lower plate, said upper plate being movable with respect to the lower plate when force is applied to the upper plate;

means operably coupling said upper and lower plates, said means permitting movement of the upper plate with respect to the lower plate;

spring means interposed between said plates for initially resisting movement of the upper plate with respect to the lower plate and for normally retaining the plates in said opposed, spaced apart generally parallel relationship; and signal means positioned between said plates and operably coupled with said force-transmitting structure whereby when said spring means is overcome and said upper plate is moved a predetermined distance toward said lower plate, a perceptible signal is given to the user.

7. A cardio pulmonary resuscitation pressure indicator as set forth in claim 6, said signal means including a deflectable spring steel body positioned for deflection thereof when said upper plate is moved with respect to said lower plate.

* * * * *